US011859886B2

(12) United States Patent
Culley

(10) Patent No.: US 11,859,886 B2
(45) Date of Patent: Jan. 2, 2024

(54) ICE MAKING ASSEMBLIES FOR MAKING CLEAR ICE

(71) Applicant: Haier US Appliance Solutions, Inc., Wilmington, DE (US)

(72) Inventor: Brian Culley, Newburgh, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 35 days.

(21) Appl. No.: 17/399,682

(22) Filed: Aug. 11, 2021

(65) Prior Publication Data

US 2023/0045814 A1 Feb. 16, 2023

(51) Int. Cl.
*F25C 1/18* (2006.01)
*F25C 1/25* (2018.01)

(52) U.S. Cl.
CPC . *F25C 1/18* (2013.01); *F25C 1/25* (2018.01)

(58) Field of Classification Search
CPC ..... F25C 1/18; F25C 1/25
See application file for complete search history.

(56) References Cited

U.S. PATENT DOCUMENTS 9,074,802 B2 7/2015 Culley
9,273,891 B2 * 3/2016 Boarman ..... F25B 21/02
10,605,512 B2 3/2020 Culley
11,454,437 B2 * 9/2022 Recine ..... F25C 1/10
2015/0027142 A1 1/2015 Little
2017/0038112 A1 * 2/2017 Papalia ..... F25C 1/18
2021/0318049 A1 * 10/2021 Moczygemba ..... F25C 1/22

FOREIGN PATENT DOCUMENTS

EP 2645021 B1 8/2016
KR 101643635 B1 7/2016
WO WO-2013109822 A2 * 7/2013 ..... F25C 1/16

* cited by examiner

*Primary Examiner* — Larry L Furdge
*Assistant Examiner* — Samba N M N Gaye
(74) *Attorney, Agent, or Firm* — Dority & Manning, P.A.

(57) ABSTRACT

An ice making assembly includes a conductive ice mold, an insulator ice mold, and an external insulator jacket. The conductive ice mold extends along a vertical direction between a top conductive mold end and a bottom conductive mold end. The conductive ice mold defines a mold cavity having a vertical opening at the top conductive mold end. The insulator ice mold is selectively received on the conductive ice mold and covers the vertical opening. The insulator ice mold defines an internal water passage extending above the mold cavity in fluid communication with the mold cavity. The external insulator jacket is selectively received on the insulator ice mold and covers the internal water passage.

19 Claims, 5 Drawing Sheets

ICE MAKING ASSEMBLIES FOR MAKING CLEAR ICE

FIELD OF THE INVENTION

The present subject matter relates generally to ice making assemblies and methods, and more particularly to assemblies and methods for making substantially clear ice.

BACKGROUND OF THE INVENTION

In domestic and commercial applications, ice is often formed as solid cubes, such as crescent cubes or generally rectangular blocks. The shape of such cubes is often dictated by the environment during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water, and such liquid water can freeze within the plurality of cavities to form solid ice cubes.

In typical ice making appliances, water in the cavities begins to freeze and solidify first from its sides and outer surfaces (including a top water surface that may be directly exposed to freezing air), and then in and through the remaining volume of water occupying the cavity. In other words, top and side surfaces of an ice cube freeze first. However, impurities and gases contained within the water to be frozen may be trapped in a solidified ice cube during the freezing process. For example, impurities and gases may be trapped near the center or the bottom surface of the ice cube, due to their inability to escape and as a result of the freezing liquid to solid phase change of the ice cube surfaces. Separate from or in addition to the trapped impurities and gases, a dull or cloudy finish may form on the exterior surfaces of an ice cube (e.g., during rapid freezing of the ice cube). Generally, a cloudy or opaque ice cube is the resulting product of typical ice making appliances.

Although typical ice cubes may be suitable for a number uses, such as temporary cold storage and rapid cooling of liquids in a wide range of sizes, they may present a number of disadvantages. As an example, impurities and gases trapped within an ice cube may impart undesirable flavors into a beverage being cooled (i.e., a beverage in which the ice cube is placed) as the ice cube melts. Such impurities and gases may also cause an ice cube to melt unevenly or faster (e.g., by increasing the exposed surface area of the ice cube). Evenly-distributed or slow melting of ice may be especially desirable in certain liquors or cocktails. Additionally or alternatively, it has been found that substantially clear ice cubes (e.g., free of any visible impurities or dull finish) may provide a unique or upscale impression for the user. Past attempts to solve such problems have generally been undesirably slow, complex, or have resulted in excessive unfrozen water, which complicates retrieval of finished cubes.

Accordingly, further improvements in the field of ice making would be desirable. In particular, it may be desirable to provide an appliance or methods for rapidly and reliably producing substantially clear ice (e.g., without being undesirably complex or leaving significant volumes of unfrozen water with the clear ice).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice making assembly is provided. The ice making assembly may include a conductive ice mold, an insulator ice mold, and an external insulator jacket. The conductive ice mold may extend along a vertical direction between a top conductive mold end and a bottom conductive mold end. The conductive ice mold may define a mold cavity having a vertical opening at the top conductive mold end. The insulator ice mold may be selectively received on the conductive ice mold and cover the vertical opening. The insulator ice mold may define an internal water passage extending above the mold cavity in fluid communication with the mold cavity. The external insulator jacket may be selectively received on the insulator ice mold and cover the internal water passage.

In another exemplary aspect of the present disclosure, an ice making assembly is provided. The ice making assembly may include a metal conductive ice mold, a non-metallic insulator ice mold, and an external insulator jacket. The metal conductive ice mold may extend along a vertical direction between a top conductive mold end and a bottom conductive mold end. The metal conductive ice mold may define a mold cavity having a vertical opening at the top conductive mold end. The metal conductive ice mold may further define an exposed surface extending along the bottom conductive mold end opposite of the vertical opening. The non-metallic insulator ice mold may be selectively received on the metal conductive ice mold radially outward from the exposed surface and cover the vertical opening. The non-metallic insulator ice mold may define an internal water passage extending above the mold cavity in fluid communication with the mold cavity. The external insulator jacket may be selectively received on the non-metallic insulator ice mold radially outward from the exposed surface and the non-metallic insulator ice mold. The external insulator jacket may cover the internal water passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
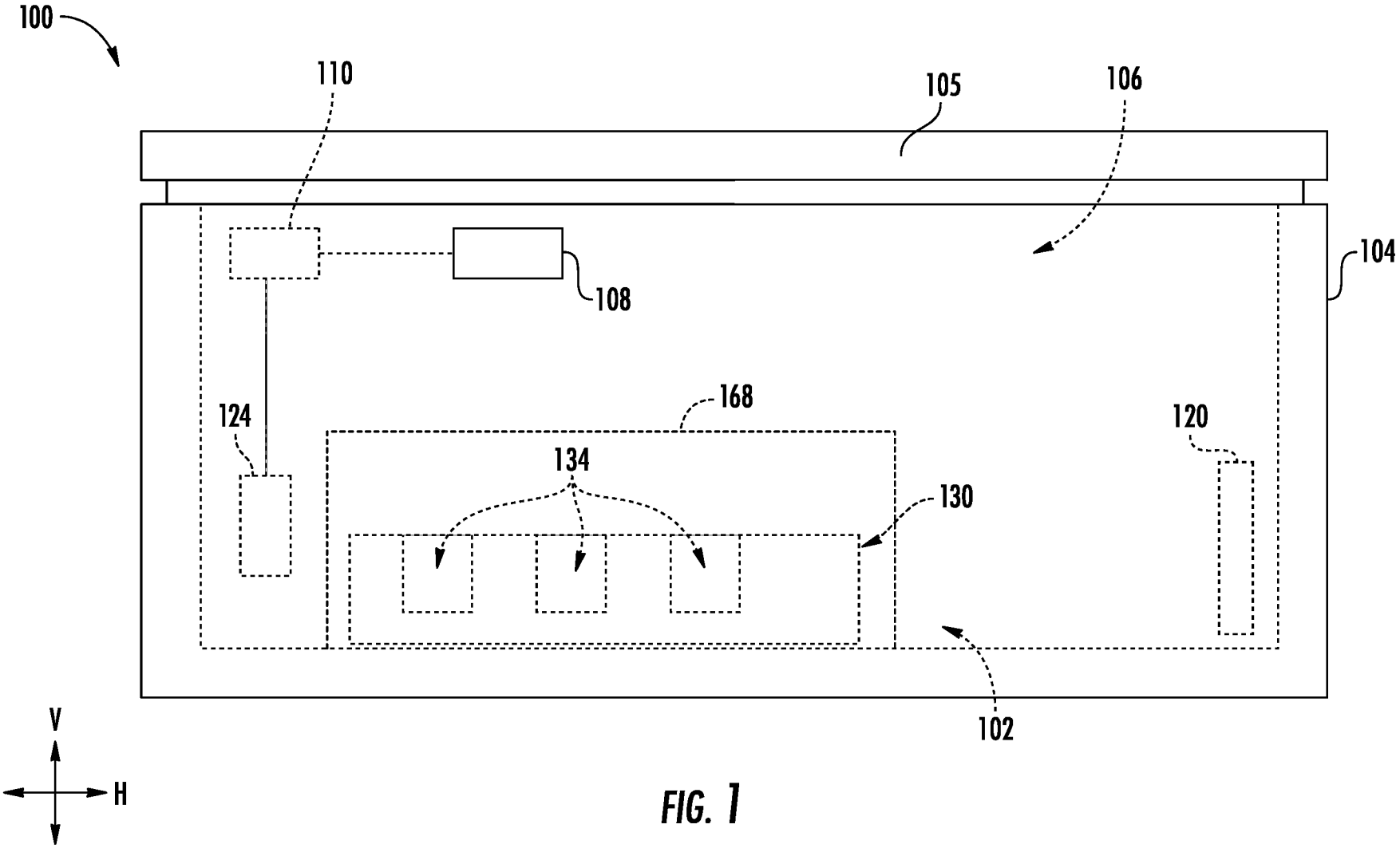
FIG. 1 provides a side plan view of an ice making appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
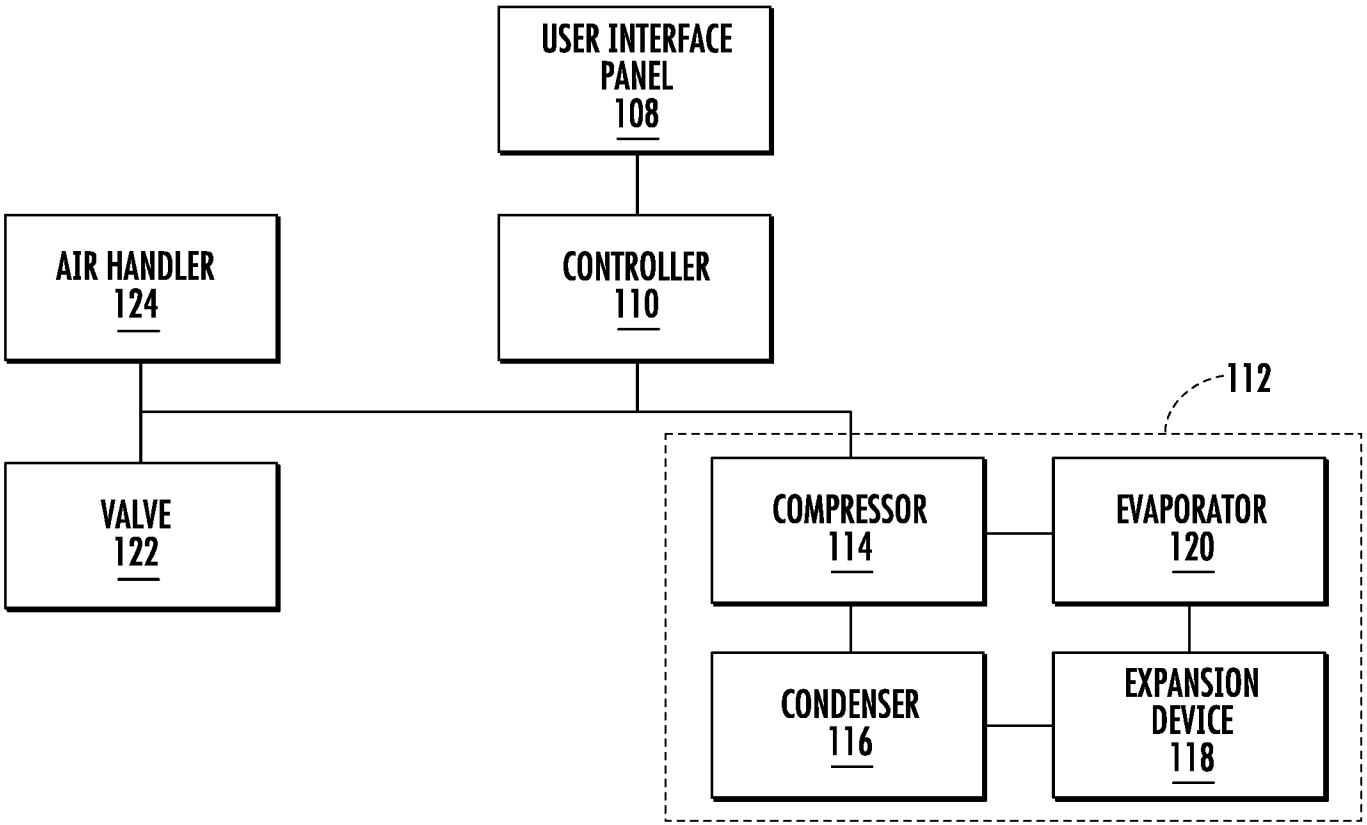
FIG. 2 provides a schematic view of an ice making appliance according to exemplary embodiments of the present disclosure.
Figure 3:
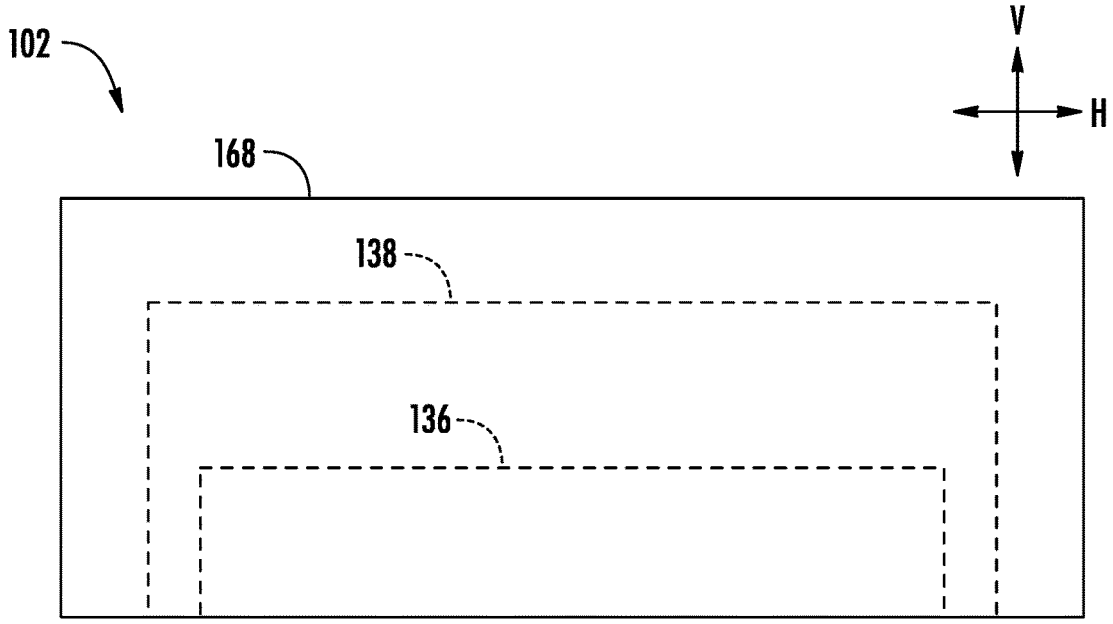
FIG. 3 provides an elevation view of a portion of an ice making assembly according to exemplary embodiments of the present disclosure.
Figure 4:
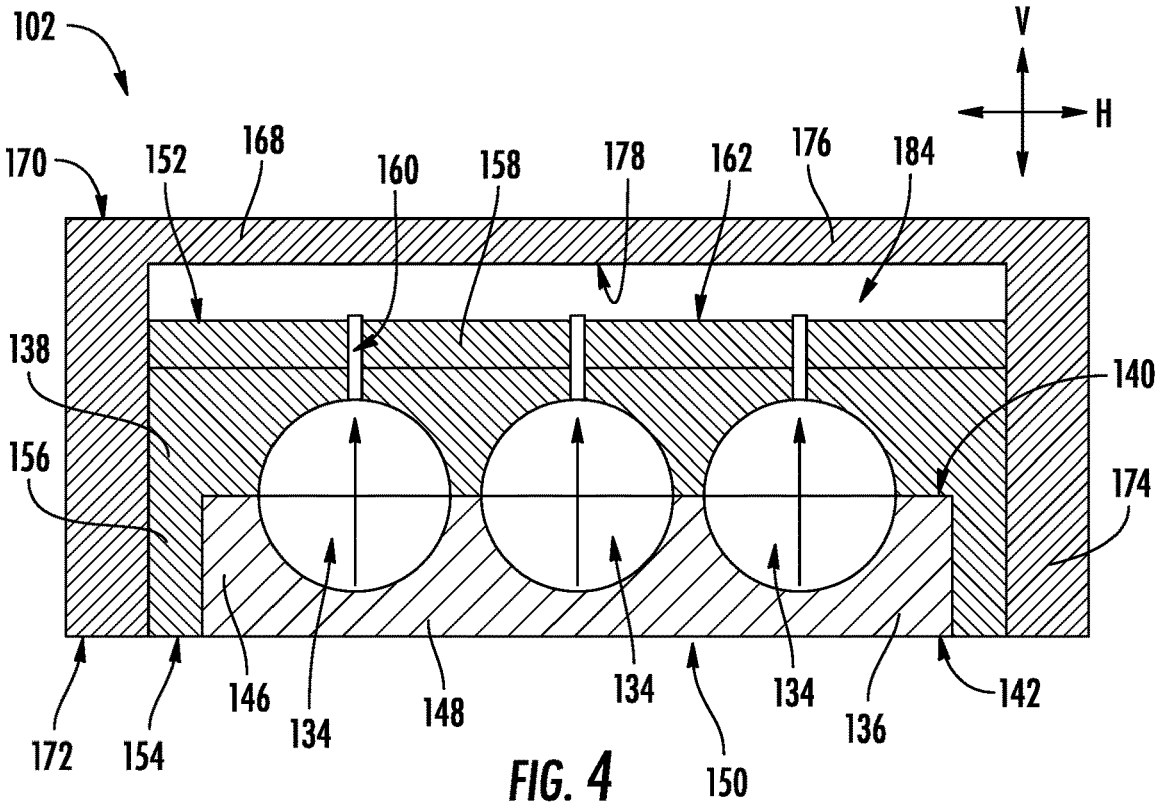
FIG. 4 provides a cross-sectional elevation view of the exemplary ice making assembly of FIG. 3.

Turning now to the figures, FIG. 1 provides a side plan view of an ice making appliance 100, including an ice making assembly 102. FIG. 2 provides an elevation view of ice making assembly 102. FIG. 3 provides a cross-sectional elevation view of a portion of ice making assembly 102. FIGS. 5 through 8 provide various views of ice making assembly 102 (or portions thereof) before, during, and after an ice making process.

Generally, ice making appliance 100 includes a cabinet 104 (e.g., insulated housing) and defines a mutually orthogonal vertical direction V, lateral direction, and transverse direction. The lateral direction and transverse direction may be generally understood to be horizontal directions H. As shown, cabinet 104 defines one or more chilled chambers, such as a freezer chamber 106. In certain embodiments, such as those illustrated by FIG. 1, ice making appliance 100 is understood to be formed as, or as part of, a stand-alone freezer appliance. It is recognized, however, that additional or alternative embodiments may be provided within the context of other refrigeration appliances. For instance, the benefits of the present disclosure may apply to any type or style of a refrigerator appliance (e.g., a top mount refrigerator appliance, a bottom mount refrigerator appliance, a side-by-side style refrigerator appliance, etc.) that includes a freezer chamber. Consequently, the description set forth herein is for illustrative purposes only and is not intended to be limiting in any aspect to any particular chamber or appliance configuration.

Ice making appliance 100 generally includes an ice making assembly 102 on or within freezer chamber 106. In some embodiments, ice making appliance 100 includes a door 105 that is rotatably attached to cabinet 104 (e.g., at a top portion of the cabinet 104). As would be understood, door 105 may selectively cover an opening defined by cabinet 104. For instance, door 105 may rotate on cabinet 104 between an open position (not pictured) permitting access to freezer chamber 106 and a closed position (FIG. 1) restricting access to freezer chamber 106.

A user interface panel 108 may be provided for controlling the mode of operation. For example, user interface panel 108 may include a plurality of user inputs (not labeled), such as a touchscreen or button interface, for selecting a desired mode of operation. Operation of ice making appliance 100 can be regulated by a controller 110 that is operatively coupled to or in wireless communication with user interface panel 108 or various other components, as will be described below. User interface panel 108 provides selections for user manipulation of the operation of ice making appliance 100 such as (e.g., selections regarding chamber temperature, ice making speed, or other various options). In response to user manipulation of user interface panel 108, or one or more sensor signals, controller 110 may operate various components of the ice making appliance 100 or ice making assembly 102.

Controller 110 may include a memory (e.g., non-transitive media) and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 110 may be positioned in a variety of locations throughout ice making appliance 100. In optional embodiments, controller 110 is located within the user interface panel 108. In other embodiments, the controller 110 may be positioned at any suitable location within ice making appliance 100, such as for example within cabinet 104. Input/output ("I/O") signals may be routed between controller 110 and various operational components of ice making appliance 100. For example, user interface panel 108 may be in operable communication with controller 110 via one or more signal lines or shared communication busses.

As illustrated, controller 110 may be in communication with the various components of appliance 100 and may control operation of the various components. For example, various valves, switches, sealed cooling systems etc. may be actuatable based on commands from the controller 110 (e.g., based on one or temperature signals received from a temperature sensor within appliance 100, as would be understood). As discussed, user interface panel 108 may additionally be in communication with the controller 110. Thus, the various operations may occur based on user input or automatically through controller 110 instruction.

In some embodiments, ice making appliance 100 includes a sealed cooling system 112 for executing a vapor compression cycle for cooling ice making assembly 102 or air within ice making appliance 100 (e.g., within freezer chamber 106). Sealed cooling system 112 includes a compressor 114, a condenser 116, an expansion device 118, and an evaporator 120 connected in fluid series and charged with a refrigerant. As will be understood by those skilled in the art, sealed cooling system 112 may include additional components (e.g., at least one additional evaporator, compressor, expansion device, or condenser). Moreover, at least one component (e.g., evaporator 120) is provided in thermal communication with freezer chamber 106 to cool the air or environment within freezer chamber 106. Optionally, evaporator 120 is mounted within freezer chamber 106, as generally illustrated in FIG. 1. It is noted that although evaporator 120 is shown as spaced apart from ice making assembly 102, alternative embodiments may include ice making assembly 102 on or in contact with evaporator 120. For instance, ice making assembly 102 may be placed on top of evaporator 120, as would be understood in light of the present disclosure.

Within sealed cooling system 112, gaseous refrigerant flows into compressor 114, which operates to increase the pressure of the refrigerant. This compression of the refrigerant raises the refrigerant temperature, which is lowered by passing the gaseous refrigerant through condenser 116. Within condenser 116, heat exchange (e.g., with ambient air takes place) to cool the refrigerant and cause the refrigerant to condense to a liquid state.

Expansion device 118 (e.g., a mechanical valve, capillary tube, electronic expansion valve, or other restriction device) receives liquid refrigerant from condenser 116. From expansion device 118, the liquid refrigerant enters evaporator 120. Upon exiting expansion device 118 and entering evaporator 120, the liquid refrigerant drops in pressure and vaporizes. Due to the pressure drop and phase change of the refrigerant, evaporator 120 is cool relative to freezer chamber 106. As such, cooled air is produced and refrigerates freezer chamber 106. Thus, evaporator 120 is a heat exchanger which transfers heat (e.g., from air passing over evaporator 120 to refrigerant flowing through evaporator 120).

Optionally, ice making appliance 100 may include a valve 122 for regulating a flow of liquid water to ice making assembly 102 from a suitable water source (e.g., on-board water tank or municipal water source). In such embodiments, valve 122 is selectively adjustable between an open configuration and a closed configuration. In the open configuration, valve 122 may permit a flow of liquid water to ice making assembly 102. Conversely, in the closed configuration, valve 122 may hinder the flow of ice making assembly 102.

In certain embodiments, ice making appliance 100 also includes an air handler 124 mounted within (or otherwise in fluid communication with) freezer chamber 106. Air handler 124 may be operable to urge a flow of chilled air (i.e., active airflow) within freezer chamber 106. Moreover, air handler 124 can be any suitable device for moving air. For example, air handler 124 can be an axial fan or a centrifugal fan. In some embodiments, air handler 124 is in operable (e.g., electrical or wireless) communication with controller 110 (e.g., to be controlled by the same).

Generally, ice making assembly 102 includes a separable mold body 130 that defines one or more mold cavities 134 in which water may be received and ice cubes or billets (e.g., solid masses or blocks of ice) may be formed. It is noted that although a single exemplary mold cavity 134 is described below, a plurality of discrete (e.g., horizontally spaced) mold cavities 134 may be provided, as shown.

During use, ice making assembly 102 may be selectively placed or received within freezer chamber 106. For example, ice making assembly 102 (e.g., the entirety of ice making assembly 102 or, alternatively, a sub portion thereof) may be removably positioned within freezer chamber 106 such that a user can selectively place ice making assembly 102 within freezer chamber 106 (e.g., during ice making operations) and remove ice making assembly 102 from freezer chamber 106 (e.g., to remove frozen ice cubes or billets from ice making assembly 102) as desired.

As shown, separable mold body 130 includes a conductive ice mold 136 and an insulator ice mold 138 that is selectively or removably disposed on conductive ice mold 136. Conductive ice mold 136 extends along the vertical direction V between a top conductive mold end 140 and a bottom conductive mold end 142. Between these ends, conductive ice mold 136 defines at least a portion of mold cavity 134 (e.g., lower mold cavity 134A) and has a vertical opening 144 to the same. For instance, a conductive sidewall 146 may extend (e.g., vertically) between the top conductive mold end 140 and the bottom conductive mold end 142. Vertical opening 144 may be defined radially inward from conductive sidewall 146. In turn, conductive sidewall 146 may radially enclose vertical opening 144 or lower mold cavity 134A. In some embodiments, vertical opening 144 is defined at top conductive mold end 140. Lower mold cavity 134A may extend downward from top conductive mold end 140 and terminate above bottom conductive mold end 142. Optionally, conductive ice mold 136 may define lower mold cavity 134A as a concave (e.g., hemispherical) recess that is upwardly open along the vertical direction V to hold or receive water (e.g., flowing vertically from above vertical opening 144).

A conductive bottom wall 148 may extend (e.g., horizontally) below or beneath mold cavity 134 (e.g., lower mold cavity 134A). For instance, conductive bottom wall 148 may extend along the bottom conductive mold end 142. In some embodiments, conductive bottom wall 148 (or bottom conductive mold end 142, generally) defines an exposed surface 150 directed away from mold cavity 134. Exposed surface 150 may thus extend (e.g., horizontally) along the bottom conductive mold end 142. Additionally or alternatively, exposed surface 150 may be defined opposite of the vertical opening 144. In certain embodiments, the vertical opening 144 defines the sole opening (e.g., for water) to lower mold cavity 134A. Additionally or alternatively, bottom conductive mold end 142 may be sealed such that water is prevented from entering or escaping conductive mold body 130 through conductive bottom wall 148 or bottom conductive mold end 142, generally.

On or around conductive ice mold 136, insulator ice mold 138 may be selectively received (e.g., to cover or enclose mold cavity 134 at the vertical opening 144). As shown, insulator ice mold 138 extends (e.g., vertically) between a top insulator mold end 152 and a bottom insulator mold end 154. For instance, insulator ice mold 138 may include an insulator sidewall 156 extending (e.g., vertically) between the top insulator mold end 152 and the bottom insulator mold end 154. An insulator top wall 158 may extend (e.g., horizontally) across insulator sidewall 156. Between top insulator mold end 152 and bottom insulator mold end 154, insulator ice mold 138 may define an internal water passage 160. Specifically, internal water passage 160 extends above the mold cavity 134 (e.g., through insulator top wall 158) in fluid communication therewith. Internal water passage 160 may extend from mold cavity 134 and to or through an upper surface 162 of insulator ice mold 138, which is directed away from the mold cavity 134. Generally, mold cavity 134 expands from and is wider than internal water passage 160. In such embodiments, the mold cavity 134 (e.g., at the vertical opening 144) defines a maximum horizontal width D1 that is greater than a maximum horizontal width D2 defined by the internal water passage 160. During use, water may thus be permitted to flow through internal water passage 160 to/from mold cavity 134 (e.g., when insulator ice mold 138 is received on conductive ice mold 136).

In some embodiments, insulator ice mold 138 further defines at least a portion of mold cavity 134. For instance, insulator ice mold 138 may define an upper mold cavity 134B. Optionally, upper mold cavity 134B may be defined within insulator top wall 158 or otherwise be disposed radially inward from insulator sidewall 156. Upper mold cavity 134B may be disposed directly beneath internal water passage 160. Moreover, upper mold cavity 134B may terminate at a cavity opening 164. In turn, upper mold cavity 134B may extend downward from internal water passage 160 and terminate above lower bottom insulator mold end 154. As shown, upper mold cavity 134B may be selectively mated with the lower mold cavity 134A to form a unitary ice billet therein. Optionally, insulator ice mold 138 may define upper mold cavity 134B as a concave (e.g., hemispherical) recess that is downward open along the vertical direction V to hold or receive water with lower mold cavity 134A (e.g., flowing vertically through internal water passage 160). In some such embodiments, ice billets formed within mold cavity may emerge as solid (e.g., clear) spheres.

Generally, insulator ice mold 138 is able to selectively cover at least a portion of conductive ice mold 136 (e.g., at vertical opening 144). In some embodiments, insulator ice mold 138 is further able to receive or enclose at least a portion of conductive ice mold 136. Insulator sidewall 156 may be disposed radially outward from conductive ice mold 136. Specifically, insulator sidewall 156 may be positioned radially outward from conductive sidewall 146 or the exposed surface 150. In some such embodiments, insulator sidewall 156 defines a mated opening 165 to an insulating cavity 166. Insulating cavity 166 may be defined beneath insulator top wall 158 or upper mold cavity 134B. At least a portion of conductive ice mold 136 may be received within insulating cavity 166. Optionally, conductive ice mold 136 nests within insulating cavity 166 such that insulator sidewall 156 covers conductive sidewall 146. Insulating cavity 166 may extend from the top conductive mold end 140 to the bottom conductive mold end 142 (e.g., below the upper mold cavity 134B). When assembled, insulator sidewall 156 may extend (e.g., fully or uninterrupted) from top conductive mold end 140 to bottom conductive mold end 142 and, thus, selectively cover conductive sidewall 146. Additionally or alternatively, the exposed surface 150 may be held uncovered within or across the mated opening 165.

Along with separable mold body 130, ice making assembly 102 includes an external insulator jacket 168. In particular, external insulator jacket 168 is selectively received on the insulator ice mold 138. When assembled, external insulator jacket 168 may cover the internal water passage 160 (e.g., to generally block internal water passage 160 from a user's view or the ambient environment). As shown, external insulator jacket 168 extends (e.g., vertically) between a top jacket end 170 and a bottom jacket end 172. For instance, external insulator jacket 168 may include a jacket sidewall 174 extending (e.g., vertically) between the top jacket end 170 and the bottom jacket end 172. An upper jacket wall 176 may extend (e.g., horizontally) across insulator sidewall 156. An internal surface 178 of upper jacket wall 176 may be directed (e.g., downward) toward insulator ice mold 138.

Generally, external insulator jacket 168 is able to selectively cover at least a portion of insulator ice mold 138 (e.g., at internal water passage 160). In some embodiments, external insulator jacket 168 is further able to receive or enclose at least a portion of insulator ice mold 138. At least a portion of jacket sidewall 174 may be disposed radially outward from insulator ice mold 138. Specifically, jacket sidewall 174 may be positioned radially outward from insulator sidewall 156. Additionally or alternatively, jacket sidewall 174 may be positioned radially outward from the exposed surface 150 of conductive ice mold 136. In some such embodiments, jacket sidewall 174 defines a jacket opening 180 for an enclosing cavity 182, which external insulator jacket 168 also defines. Specifically, enclosing cavity 182 may be defined beneath upper jacket wall 176. At least a portion of insulator ice mold 138 may be received within enclosing cavity 182. Optionally, insulator ice mold 138 nests within enclosing cavity 182 such that jacket sidewall 174 covers insulator sidewall 156. Enclosing cavity 182 may extend from the top insulator mold end 152 to the bottom insulator mold end 154. When assembled, jacket sidewall 174 may extend (e.g., fully or uninterrupted) from top jacket end 170 to bottom jacket end 172 and, thus, selectively cover insulator sidewall 156. Additionally or alternatively, the exposed surface 150 may be held uncovered within the jacket opening 180.

In certain embodiment, external insulator jacket 168 defines an excess water chamber 184 with insulator ice mold 138. For instance, a vertical gap or distance may be maintained between the upper surface 162 of the insulator ice mold 138 and the internal surface 178 of the external insulator jacket 168. In particular, the excess water chamber 184 may be defined within this vertical gap between the upper surface 162 of the insulator ice mold 138 and the internal surface 178 of the external insulator jacket 168. As shown, the internal water passage 160 may extend to the excess water chamber 184 and, thus, be in fluid communication between the excess water chamber 184 and the mold cavity 134.

Generally, the various components of ice making assembly 102 may each be formed from any suitable material. Nonetheless, the materials used to form discrete components may be distinct. In particular, conductive ice mold 136 is formed of a different material than insulator ice mold 138. Moreover, conductive ice mold 136 may have a (e.g., first) thermal coefficient that is greater than a (e.g., second) thermal coefficient of the insulator ice mold 138. For instance, conductive ice mold 136 may be a metal conductive ice mold while insulator ice mold 138 may be a non-metallic insulator ice mold. Thus, conductive ice mold 136 may be formed of a suitable heat-conductive metal for facilitating the removal of heat from mold cavity 134, such as aluminum or stainless steel (e.g., including combinations or alloys thereof). Additionally or alternatively, insulator ice mold 138 may be formed of a suitable heat-insulating polymer for restricting heat transfer to one or more portions of mold cavity 134, such as silicone, polycarbonate or polyethylene (e.g., including combinations or variations thereof).

In certain embodiments, the conductive ice mold 136 is also formed from a different material than the external insulator jacket 168. Specifically, the first thermal coefficient of the conductive ice mold 136 may be greater than a (e.g., third) thermal coefficient of the external insulator jacket 168. For instance, external insulator jacket 168 may formed of a suitable heat-insulating polymer for restricting heat transfer to one or more portions of mold cavity 134, such as silicone, polycarbonate or polyethylene (e.g., including combinations or variations thereof). The material of the external insulator jacket 168 may be the same as the insulator ice mold 138. Alternatively, the material of the external insulator jacket 168 may be the same as the insulator ice mold 138. The third and second thermal coefficients may be substantially equal or, alternatively, different (e.g., such that the third thermal coefficient is less than the second thermal coefficient).

Optionally, conductive ice mold 136, insulator ice mold 138, or external insulator jacket 168 may each be formed as a discrete, unitary or integral component. As an example, conductive ice mold 136 may be a solid, unitary member of a first material. As an additional or alternative example, insulator ice mold 138 may be a solid, unitary member of a second material. As another additional or alternative example, external insulator jacket 168 may be a solid, unitary member of a third material.

Figure 5:
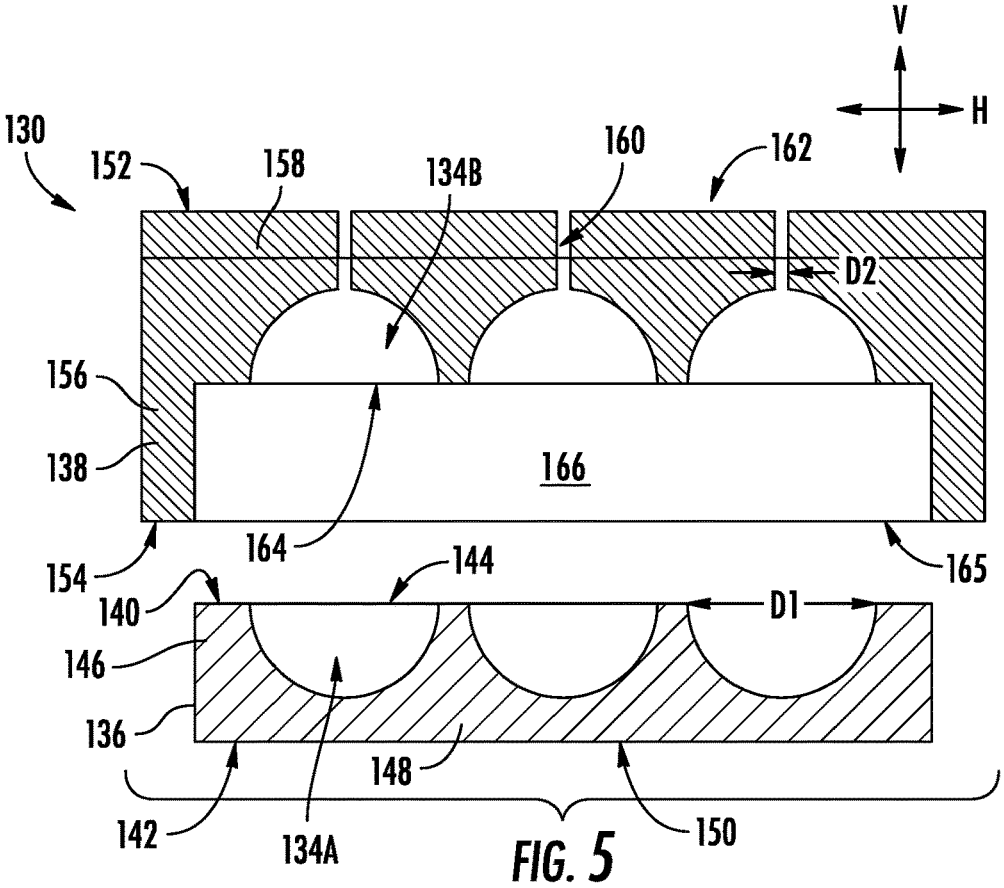
FIG. 5 provides a cross-sectional elevation view of a portion of the exemplary ice making assembly of FIG. 3, prior to receiving water therein.
Figure 6:
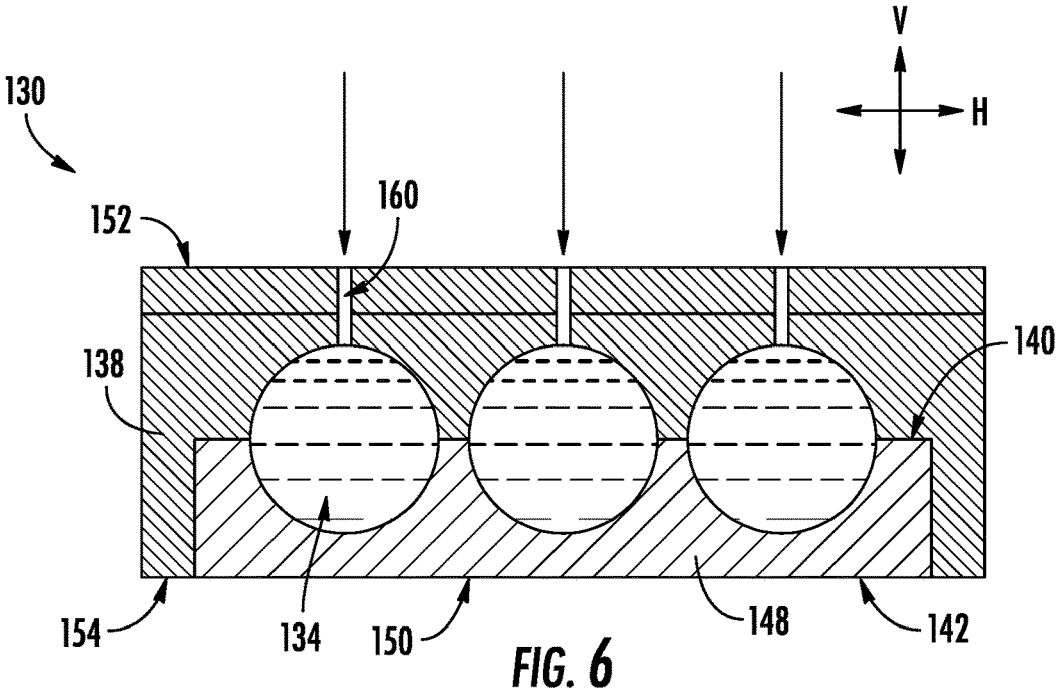
FIG. 6 provides a cross-sectional elevation view of a portion of the exemplary ice making assembly of FIG. 3, while receiving water therein.
Figure 7:
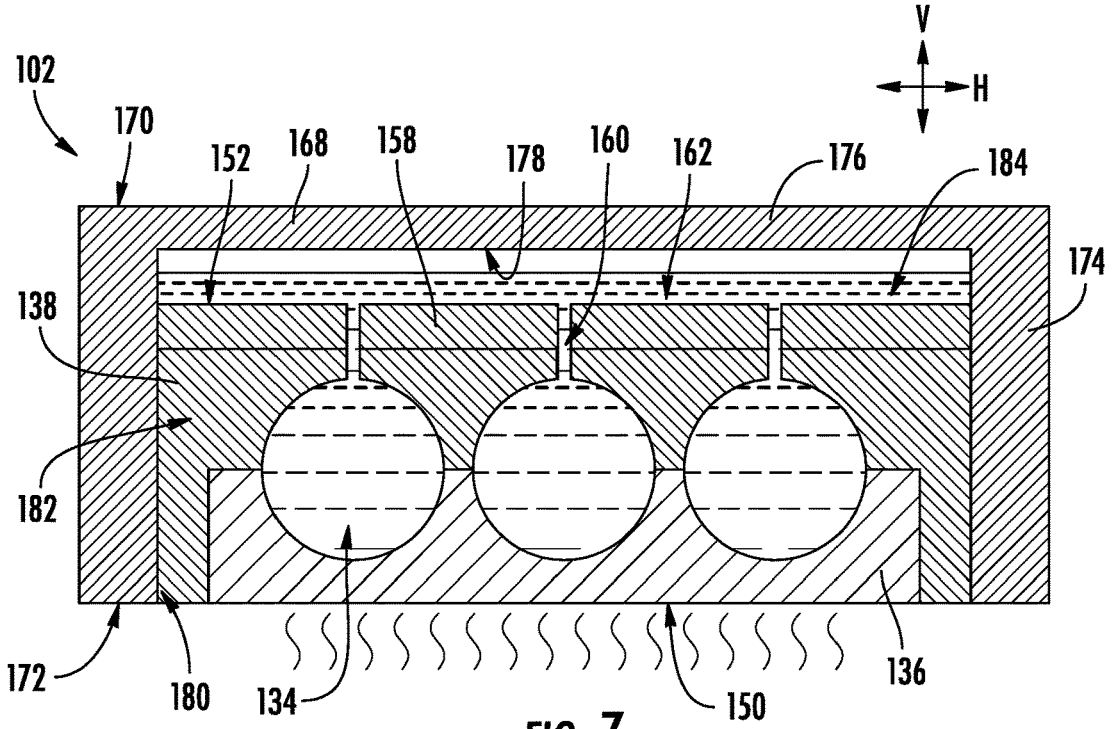
FIG. 7 provides a cross-sectional elevation view of the exemplary ice making assembly of FIG. 3, during a freezing process to form ice billets therein.
Figure 8:
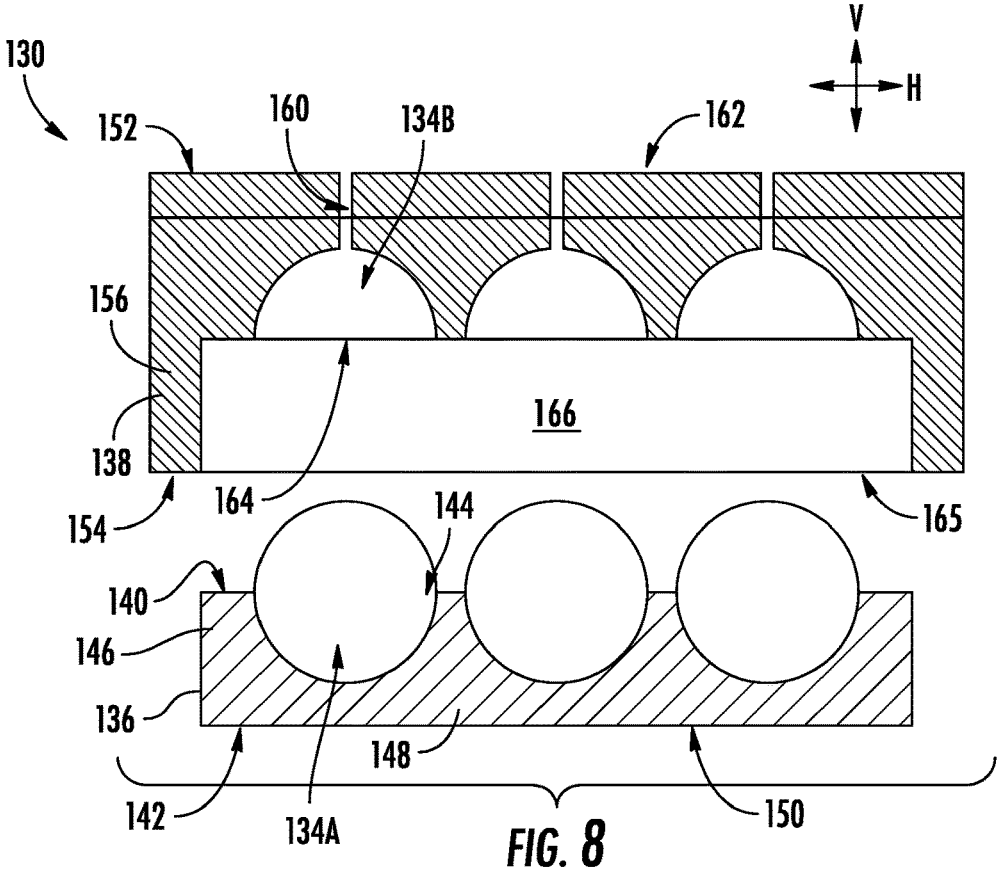
FIG. 8 provides a cross-sectional elevation view of a portion of the exemplary ice making assembly of FIG. 3, following the freezing of ice billets therein.

Turning especially to FIGS. 5 through 8, exemplary steps for using ice making assembly 102 are illustrated (e.g., by showing ice making assembly in various stages). As shown in FIG. 5, prior to providing water to mold cavity 134, insulator ice mold 138 may be selectively mated onto conductive ice mold 136 such that conductive ice mold 136 is received within insulator ice mold 138, thereby assembling separable mold body 130. As shown in FIG. 6, once separable mold body 130 is assembled, water may be provided to mold cavity 134 (e.g., through internal water passage 160). After water fills mold cavity 134, external insulator jacket 168 is mated onto insulator ice mold 138 such that insulator ice mold 138 and conductive ice mold 136 are received within external insulator jacket 168. Moreover, heat may be conducted from mold cavity 134 (e.g., within freezer chamber 106—FIG. 1) through conductive ice mold 136 and the exposed surface 150, as illustrated in FIG. 7. The conduction of heat from mold cavity 134 may cause an ice billet to form within mold cavity 134 as water freezes from the bottom of mold cavity 134 and notably forces impurities upward away from mold (e.g., with unfrozen water to excess water chamber 184 through internal water passage 160). Notably impurities and excess water may be carried away from mold cavity 134 to avoid the formation of a cloudy ice billet within mold 134. As shown in FIG. 8, after an ice billet is formed, external insulator jacket 168 and insulator ice mold 138 may be removed from conductive ice mold 136, allowing a user to access and remove one or more frozen ice billets.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

a conductive ice mold extending along a vertical direction between a top conductive mold end and a bottom conductive mold end, the conductive ice mold defining a mold cavity having a vertical opening at the top conductive mold end;

an insulator ice mold selectively received on the conductive ice mold and covering the vertical opening, the insulator ice mold defining an internal water passage extending above the mold cavity in fluid communication with the mold cavity; and an external insulator jacket selectively received on the insulator ice mold and covering the internal water passage, wherein the non-metallic insulator ice mold defines an upper surface directed away from the mold cavity, wherein the external insulator jacket comprises an upper jacket wall having an uninterrupted internal surface directed toward the non-metallic insulator ice mold, wherein an excess water chamber is defined between the upper surface of the non-metallic insulator ice mold and the uninterrupted internal surface of the external insulator jacket, wherein the internal water passage extends through the upper surface in fluid communication with the excess water chamber, wherein the conductive ice mold comprises a conductive sidewall extending from the top conductive mold end to the bottom conductive mold end, and wherein the insulator ice mold selectively covers the conductive sidewall from the top conductive mold end to the bottom conductive mold end.

2. The ice making assembly of claim 1, wherein the conductive ice mold has a first thermal coefficient, wherein the insulator ice mold has a second thermal coefficient, wherein the external insulator jacket has a third thermal coefficient, and wherein the first thermal coefficient is greater than second thermal coefficient and the third thermal coefficient.

3. The ice making assembly of claim 1, wherein the conductive ice mold defines an exposed surface extending along the bottom conductive mold end, wherein the insulator ice mold defines a mated opening, and wherein the exposed surface is held uncovered within the mated opening.

4. The ice making assembly of claim 1, wherein the insulator ice mold comprises an insulator sidewall extending from a top insulator mold end to a bottom insulator mold end, and wherein the external insulator jacket selectively covers the insulator sidewall from the top insulator mold end to the bottom insulator mold end.

5. The ice making assembly of claim 4, wherein the conductive ice mold defines an exposed surface extending along the bottom conductive mold end, wherein the external insulator jacket defines a jacket opening, and wherein the exposed surface is held uncovered within the jacket opening.

6. The ice making assembly of claim 1, wherein the vertical opening defines a maximum horizontal width as a maximum dimension of the vertical opening perpendicular to the vertical direction, wherein the internal water passage defines a maximum horizontal width as a maximum dimension of the internal water passage perpendicular to the vertical direction, and wherein the maximum horizontal width of the vertical opening is greater than the maximum horizontal width of the internal water passage.

7. The ice making assembly of claim 1, wherein the mold cavity is a lower mold cavity, wherein the insulator ice mold defines an upper mold cavity selectively mated with the lower mold cavity to form a unitary ice billet therein, the upper mold cavity being disposed directly beneath the internal water passage.

8. The ice making assembly of claim 7, wherein the insulator ice mold defines an insulating cavity extending from the top conductive mold end to the bottom conductive mold end below the upper mold cavity.

9. An ice making assembly comprising:

a metal conductive ice mold extending along a vertical direction between a top conductive mold end and a bottom conductive mold end, the metal conductive ice mold defining a mold cavity having a vertical opening at the top conductive mold end, the metal conductive ice mold further defining an exposed surface extending along the bottom conductive mold end opposite of the vertical opening;

a non-metallic insulator ice mold selectively received on the metal conductive ice mold radially outward from the exposed surface and covering the vertical opening, the non-metallic insulator ice mold defining an internal water passage extending above the mold cavity in fluid communication with the mold cavity; and an external insulator jacket selectively received on the non-metallic insulator ice mold radially outward from the exposed surface and the non-metallic insulator ice mold, the external insulator jacket covering the internal water passage, wherein the insulator ice mold defines an upper surface directed away from the mold cavity, wherein the external insulator jacket comprises an upper jacket wall having an uninterrupted internal surface directed toward the insulator ice mold, wherein an excess water chamber is defined between the upper surface of the insulator ice mold and the uninterrupted internal surface of the external insulator jacket, and wherein the internal water passage extends through the upper surface in fluid communication with the excess water chamber.

10. The ice making assembly of claim 9, wherein the metal conductive ice mold has a first thermal coefficient, wherein the non-metallic insulator ice mold has a second thermal coefficient, wherein the external insulator jacket has a third thermal coefficient, and wherein the first thermal coefficient is greater than second thermal coefficient and the third thermal coefficient.

11. The ice making assembly of claim 9, wherein the metal conductive ice mold comprises a conductive sidewall extending from the top conductive mold end to the bottom conductive mold end, and wherein the non-metallic insulator ice mold selectively covers the conductive sidewall from the top conductive mold end to the bottom conductive mold end.

12. The ice making assembly of claim 11, wherein the non-metallic insulator ice mold defines a mated opening, and wherein the exposed surface is held uncovered within the mated opening.

13. The ice making assembly of claim 9, wherein the non-metallic insulator ice mold comprises an insulator sidewall extending from a top insulator mold end to a bottom insulator mold end, wherein the external insulator jacket selectively covers the insulator sidewall from the top insulator mold end to the bottom insulator mold end, and wherein the external insulator jacket defines a jacket opening, and wherein the exposed surface is held uncovered within the jacket opening.

14. The ice making assembly of claim 9, wherein the vertical opening defines a maximum horizontal width as a maximum dimension of the vertical opening perpendicular to the vertical direction, wherein the internal water passage defines a maximum horizontal width as a maximum dimension of the internal water passage perpendicular to the vertical direction, and wherein the maximum horizontal width of the vertical opening is greater than the maximum horizontal width of the internal water passage.

15. The ice making assembly of claim 9, wherein the mold cavity is a lower mold cavity, wherein the non-metallic insulator ice mold defines an upper mold cavity selectively mated with the lower mold cavity to form a unitary ice billet therein, the lower mold cavity being disposed beneath the internal water passage.

16. The ice making assembly of claim 15, wherein the metal conductive ice mold comprises a conductive sidewall extending from the top conductive mold end to the bottom conductive mold end, and wherein the non-metallic insulator ice mold defines an insulating cavity extending from the top conductive mold end to the bottom conductive mold end below the upper mold cavity.

17. An ice making assembly comprising:

a metal conductive ice mold extending along a vertical direction between a top conductive mold end and a bottom conductive mold end, the metal conductive ice mold defining a mold cavity having a vertical opening at the top conductive mold end, the metal conductive ice mold further defining an exposed surface extending along the bottom conductive mold end opposite of the vertical opening;

a non-metallic insulator ice mold selectively received on the metal conductive ice mold radially outward from the exposed surface and covering the vertical opening, the non-metallic insulator ice mold defining an internal water passage extending above the mold cavity in fluid communication with the mold cavity; and an external insulator jacket selectively received on the non-metallic insulator ice mold radially outward from the exposed surface and the non-metallic insulator ice mold, the external insulator jacket covering the internal water passage, wherein the non-metallic insulator ice mold defines an upper surface directed away from the mold cavity, wherein the external insulator jacket comprises an upper jacket wall having an uninterrupted internal surface directed toward the non-metallic insulator ice mold, wherein an excess water chamber is defined above the mold cavity between the upper surface of the non-metallic insulator ice mold and the uninterrupted internal surface of the external insulator jacket, wherein the internal water passage extends through the upper surface in fluid communication with the excess water chamber, wherein the mold cavity is a lower mold cavity, wherein the non-metallic insulator ice mold defines an upper mold cavity selectively mated with the lower mold cavity to form a unitary ice billet therein, the upper mold cavity being disposed directly beneath the internal water passage, wherein the metal conductive ice mold comprises a conductive sidewall extending from the top conductive mold end to the bottom conductive mold end, and wherein the non-metallic insulator ice mold defines an insulating cavity extending from the top conductive mold end to the bottom conductive mold end below the upper mold cavity.

18. The ice making assembly of claim 17, wherein the metal conductive ice mold comprises a conductive sidewall extending from the top conductive mold end to the bottom conductive mold end, wherein the non-metallic insulator ice mold selectively covers the conductive sidewall from the top conductive mold end to the bottom conductive mold end, wherein the non-metallic insulator ice mold defines a mated opening, wherein the non-metallic insulator ice mold comprises an insulator sidewall extending from a top insulator mold end to a bottom insulator mold end, wherein the external insulator jacket selectively covers the insulator sidewall from the top insulator mold end to the bottom insulator mold end, and wherein the exposed surface is held uncovered within the mated opening and a jacket opening.

19. The ice making assembly of claim 17, wherein the vertical opening defines a maximum horizontal width as a maximum dimension of the vertical opening perpendicular to the vertical direction, wherein the internal water passage defines a maximum horizontal width as a maximum dimension of the internal water passage perpendicular to the vertical direction, and wherein the maximum horizontal width of the vertical opening is greater than the maximum horizontal width of the internal water passage.

* * * * *